US007603815B2

(12) United States Patent
Kawai et al.

(10) Patent No.: US 7,603,815 B2
(45) Date of Patent: Oct. 20, 2009

(54) PANEL STRUCTURE OF STEEL HOUSE AND PANEL CONSTRUCTING METHOD

(75) Inventors: Yoshimichi Kawai, Tokyo (JP); Kazunori Fujihashi, Tokyo (JP); Shigeaki Tohnai, Tokyo (JP); Hiroshi Tanaka, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 404 days.

(21) Appl. No.: 10/563,552

(22) PCT Filed: Jul. 21, 2005

(86) PCT No.: PCT/JP2005/013776

§ 371 (c)(1),
(2), (4) Date: Jan. 4, 2006

(87) PCT Pub. No.: WO2006/057094

PCT Pub. Date: Jun. 1, 2006

(65) Prior Publication Data

US 2007/0119111 A1 May 31, 2007

(51) Int. Cl.
*E04H 1/00* (2006.01)
*E04B 5/00* (2006.01)

(52) U.S. Cl. ..... 52/79.1; 52/262; 52/272

(58) Field of Classification Search ..... 52/742.1, 52/79.1, 76, 77, 79.9, 79.12, 236.3, 236.6, 52/236.7, 236.9, 261, 262, 264, 266, 267, 52/269, 271, 272

See application file for complete search history.

(56) References Cited

U.S. PATENT DOCUMENTS

| | | | | |
|---|---|---|---|---|
| 5,782,047 | A * | 7/1998 | De Quesada | 52/236.6 |
| 2003/0024174 | A1 * | 2/2003 | Bonds et al. | 52/79.1 |
| 2004/0103596 | A1 * | 6/2004 | Don et al. | 52/79.1 |
| 2005/0210762 | A1 * | 9/2005 | Broberg | 52/79.1 |

FOREIGN PATENT DOCUMENTS

| | | |
|---|---|---|
| JP | 10311110 | 11/1998 |
| JP | 11140975 | 5/1999 |
| JP | 3090659 | 12/2002 |
| JP | 2003-147852 | 5/2003 |
| WO | WO 03/042467 | 5/2003 |

* cited by examiner

*Primary Examiner*—Richard E Chilcot, Jr.
*Assistant Examiner*—Jessica Laux
(74) *Attorney, Agent, or Firm*—Kenyon & Kenyon LLP

(57) ABSTRACT

A panel structure of a steel house built by constructing multi-story structural frameworks by forming wall panels by fastening face members to rectangular frames of light-gage channels of sheet steels, constructing walls of each story by disposing said wall panels along the four sides of a rectangle, and assembling said wall panels and a floor panel consisting of a wall plate mounted on floor joists, the panel structure characterized in that side ends of said floor panel are connected to the inner upper end of the wall panels of the lower story, and the end edges of the wall panels of the upper and lower stories on at least two opposite sides of said four sides are butt-joined.

4 Claims, 7 Drawing Sheets

(a)

(b)

(a)

(b)

PANEL STRUCTURE OF STEEL HOUSE AND PANEL CONSTRUCTING METHOD

TECHNICAL FIELD

The present invention relates to a steel panel structure of steel house and a panel constructing method.

BACKGROUND ART

Steel houses are commonly defined as steel panel structure buildings composed of combinations of light-gage shapes of sheet steels not less than 0.4 mm and less than 2.3 mm in thickness and structural panels. When constructing relatively-low multi-floor buildings, such as two- or three-floor building, the platform construction method (the so-called frame-wall construction method), in which the floor of the ground floor is first completed, the wall panels for the ground floor are then mounted on the completed floor, and the floor panel for the upper floor is mounted on the wall panels of the ground panel, have often been used.

This platform construction method has an advantage that heavy machines and scaffolds are unnecessary.

On the other hand, the platform construction method integrates the wall panels of upper and lower stories by using hold-down hardware (sometimes abbreviated as the HD hardware) and long bolts. As, in addition, joist ends of the floor panel are inserted between the wall panels of the upper and lower stories, metal reinforcements which transfer compressive force are inevitably provided to receive the compressive force operating on the joists. The hold-down hardware and metal reinforcements complicate the structure of steel houses. This is a problem in the platform construction method.

The present steel house design method based on the platform construction method is explained by referring to schematic drawings of FIG. 6. As illustrated in FIG. 6, in the platform construction method, the floor of the ground floor (not shown) is first completed, and then the walls 2 of the ground floor is constructed by mounting the wall panels 1 for one story thereon. After the completion of the walls 2 of the ground floor, the floor panel 3 for the upper story is mounted and, then, the walls 4 of the second story are constructed by mounting the wall panels 1 for one story on said floor panel 3.

The wall panel 1 is formed by connecting a structural face plate to a rectangular wall frame which is formed by assembling vertical frame members and top and bottom horizontal frame members to be a rectangle. The floor panel 3 is formed by connecting a floor plate to side and end joists.

In a steel house built as described above by the platform construction method, the walls 2 and 4 of the upper and lower stories are joined together by hold-down hardware 5 and other connection hardware through the floor 3*a*.

Japanese Unexamined Patent Publication No. 10-311110 discloses an example of the joined structure described above, as shown in FIG. 7.

In FIG. 7, a wall panel 1 for the upper and lower stories is formed by connecting a structural face plate 13 (hereinafter referred to as the face plate) to a wall frame composed of vertical frame members 10, a top horizontal frame members 11 and a bottom horizontal frame members 12, all of which are made of light-gage channels of sheet steels. The vertical frame members 10 of the upper and lower stories are fastened together by the hold-down hardware 5, as illustrated in FIG. 7.

The floor panel 3 comprising a floor plate 17 mounted on side and end joists of light-gage channels of sheet steels is disposed between the upper end of the wall panel 1 of the lower story and the lower end of the wall panel 1 of the upper story as a partition therebetween. Connection hardware 8 is attached to the floor panel 3.

The connection hardware 8 comprises a cylindrical bolt holder 6 and horizontal flanges 7 fastened at the top and bottom ends thereof, said top and bottom flanges 7 having a bolt insertion hole 7*a*. The upper and lower wall panels 1 are joined together by connecting a bolt 14 passed through the bolt holder 6 of the connection hardware to the hold-down hardwares 5 attached to the wall panels 1 of the upper and lower stories.

The connection hardware 8 is vertically mounted so as to contact the top and bottom ends of the joists 15 and 16, whereas the bolt 14 is passed along the hold-down hardware 5 of the lower story and through the bolt holder 6 of the connection hardware 8 and the floor plate 17 and the bottom frame member 12 of the wall frame of the upper story, and then fastened by a nut 18 to the hold-down hardware 5 of the upper story. The lower end of the bolt 14 is similarly fastened by a nut 18 to the hold-down hardware 5 of the lower story. Thus, the hold-down hardware 5 joins the wall panels 1 of the upper and lower stories by way of the floor panel 3.

The platform construction method just described requires intricate design that, in turn, makes field work difficult because connection of the wall panel 1 to the floor panel 3 and that of the wall panels 1 of the upper and lower stories require hold-down hardware 5, connection hardware 8 and other metal reinforcements.

If such metal reinforcements are eliminated or reduced in order to avoid an increase in the number of structural members and complicated design, the construction work becomes hazardous. Furthermore, the conventional platform construction method tends to require intricate design because load transfer paths are complicated.

Japanese Unexamined Patent Publication No. 11-140975 discloses a method for improving the platform construction method requiring hold-down hardware. This improving method provides multiple vertical frame studs constituting a wall surface frame so that the studs are expanded throughout the whole stories, and fastens a floor panel on the side of the studs laterally and a wall panel surface member on the surface of the studs vertically.

However, the technology disclosed in Japanese Unexamined Patent Publication No. 11-140975 defies a simple method usable with the platform construction method in which unitized wall panels, which are prepared by fastening a structural surface member to a rectangular wall frame, are joined together, one story after another. The technology disclosed in Japanese Unexamined Patent Publication No. 11-140975 involves a problem that time and trouble in field work increases because wall panel surface members must be attached at the construction site after all vertical frame studs extending to the uppermost story have been joined together.

SUMMARY OF THE INVENTION

First, the present invention provides a steel house frame structure that eliminates a shortcoming with the conventional platform construction method that the use of hold-down and other reinforcing hardware results in a complicated construction. At the same time, the present invention exploits an advantage of the conventional platform construction method that eliminates the need for heavy machines and scaffolds by completing walls one story after another.

Second, the present invention eliminates another shortcoming with the construction method described in Japanese Unexamined Patent Publication No. 11-140975 that does not require hold-down and other hardware and, therefore, permits a simple construction. The conventional method described earlier has a shortcoming that the time and trouble required in field work increases because structural face members (wall members) are attached on site after vertical frame studs extending to the uppermost story have been built. The present invention reduces this need for field work.

In order to achieve the aforementioned objects, the present invention is composed as follows.

The first invention is the panel structure of a steel house built by constructing multi-story structural frameworks by forming wall panels by fastening face members to rectangular frames of light-gage channels of sheet steels, constructing walls of each story by disposing said wall panels along the four sides of a rectangle, and assembling said wall panels and a floor panel consisting of a wall plate mounted on floor joists, characterized by that; side ends of said floor panel are connected to the inner upper end of the wall panels of the lower story and the end edges of the wall panels of the upper and lower stories on at least two opposite sides of said four sides are butt-joined.

The second invention is the panel structure according to the first invention described above, in which; the upper edges of the wall panels of the lower story on two opposite sides are held lower than the upper edges of the wall panels of the lower story on other two opposite sides and both edges of said floor panel are mounted on the upper edges of the lower wall panels of the lower story on two opposite sides, the upper surface of said floor panel is held by the lower edges of wall panels of the upper story on two opposite sides, and both sides of said floor panel are connected to the inner upper end of the higher wall panels of the lower story on the other two opposite sides, and the end edges of the higher wall panels of the lower story on two opposite sides and the end edges of the wall panels of the upper story on two opposite sides are butt-joined.

The third invention is the panel structure, according to the first or second invention, in which; the end edges of the wall panels of the upper and lower stories on two opposite sides are butt-joined by using rigid hardware whose upper and lower parts are anchored by fasteners to the wall frames of the wall panels of the upper and lower stories.

The fourth invention is the panel structure, according to the third invention, in which; said connection hardware is made of tubular steel of a given length compressed at both ends, said tubular steel being passed through an opening in the web of the upper and lower frames of light-gage channels of sheet steels and the compressed parts of the upper and lower tubular steels being anchored by fasteners to the web of the wall frames.

The fifth invention is the method for constructing the panel structure according to any of the first to fourth invention, characterized by comprising steps of; constructing the walls of a lower story by disposing wall panels along the four sides of a rectangle, connecting at least two opposite sides of the wall panel to the inner upper end of the wall panels of the lower story, supporting the wall panel of an upper story by the wall panels of the lower story, and constructing the walls of the upper story by connecting the lower end of the wall panels of the upper story to the upper end of the wall panels of the lower story.

The sixth invention is the method for constructing a panel structure, according to the fifth invention, which includes steps of; supporting both ends of the floor panel by the upper end of the wall panels of the lower story on two opposite sides that are lower than those on the other two opposite sides, connecting both sides of said floor panel to the upper inner end of the wall panels of the lower story, and holding the upper face at both ends of the floor panel by the lower end of the wall panels of the upper story on the other two opposite sides.

In addition, in the method for constructing a panel structure according to the fifth or sixth invention it is preferable to include a step of connecting the wall panels of the upper and lower stories by using the connection hardware described in the third or fourth invention.

The present invention has the following advantages: (1) Direct connection of the wall panels of upper and lower stories of a steel house permits simplifying framework construction, eliminating the need for hold-down and other complicated reinforcing hardware, reducing field work load, simplifying design and boosting construction efficiency; and (2) Connecting only the inner wall members by way of the floor panel as in the conventional method permits constructing a framework while retaining the advantage of the conventional platform construction method of not requiring heavy machines and scaffolds because each story can be constructed by using unitized wall panels.

BRIEF DESCRIPTION OF THE DRAWINGS

FIG. 2(*a*) shows parts A in FIG. 1, and FIG. 2(*b*) shows parts B in FIG. 1.

FIG. 3(*a*) is a perspective view, and FIG. 3(*b*) is a vertical cross-sectional view.

FIG. 4(*a*) is a cross-sectional view at D-D in FIG. 4(*b*). FIG. 4(*b*) is a side view of a connection structure of the wall panels of upper and lower stories. FIG. 4(*c*) is a cross-sectional view at E-E in FIG. 4(*d*). FIG. 4(*d*) is a front view of the connection structure of the wall panels of upper and lower stories.

FIG. 5(*a*) is a front view. FIG. 5(*b*) is a side view. FIGS. 5(*c*) and 5(*d*) show a process to compress the top and bottom ends of a tubular steel that is made into connection hardware.

FIG. 6(*a*) is an overall view and FIG. 6(*b*) is a detailed view of part C in FIG. 6(*a*).

FIG. 7(*a*) is an overall view, and FIG. 7(*b*) is a perspective view of a connection hardware disassembled.

THE MOST PREFERRED EMBODIMENT

Embodiments of the present invention are described below by referring to the accompanying drawings.

Figure 1:
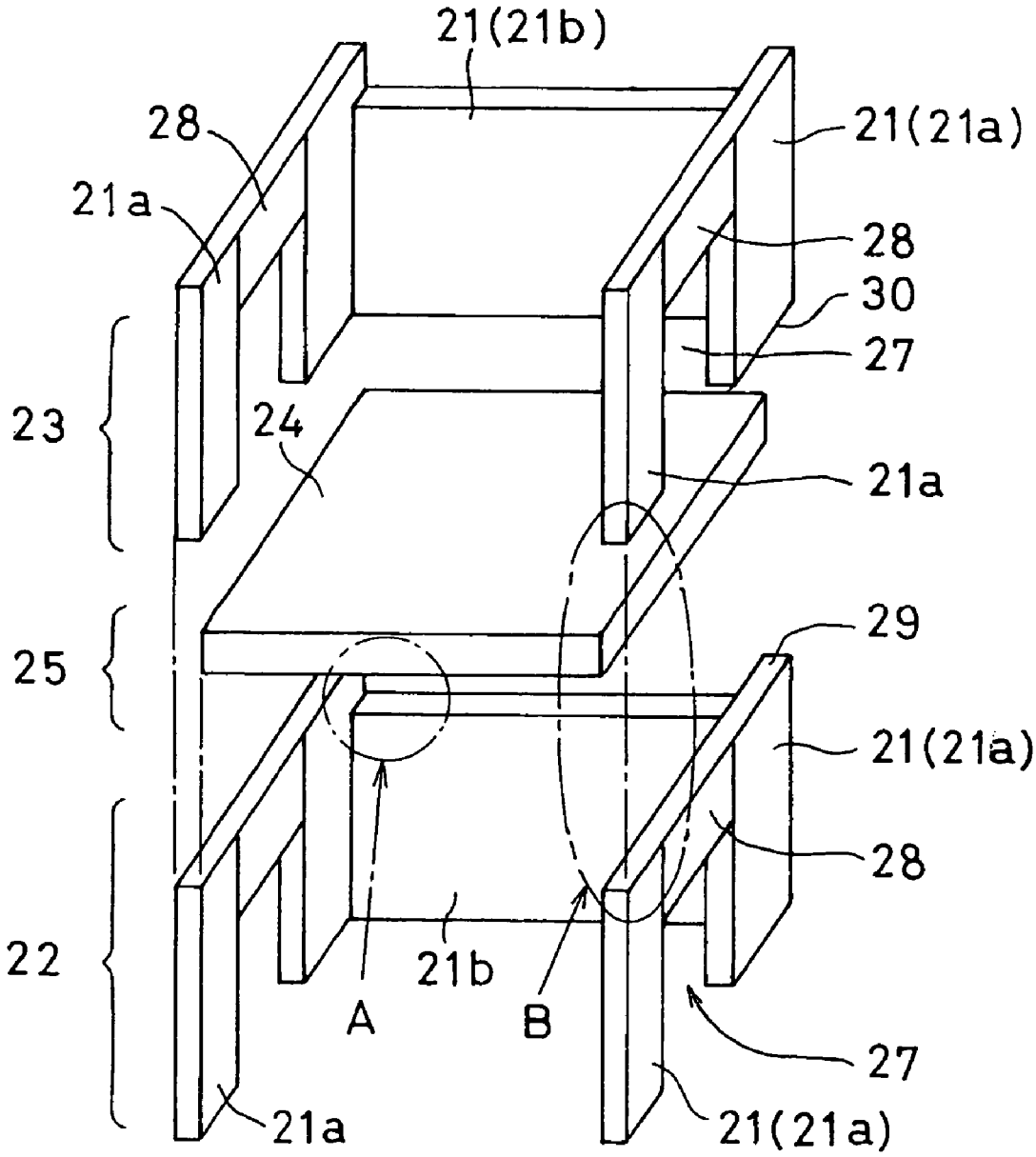
FIG. 1 shows an example of the structure of a steel house according to the present invention schematically.
Figure 2:
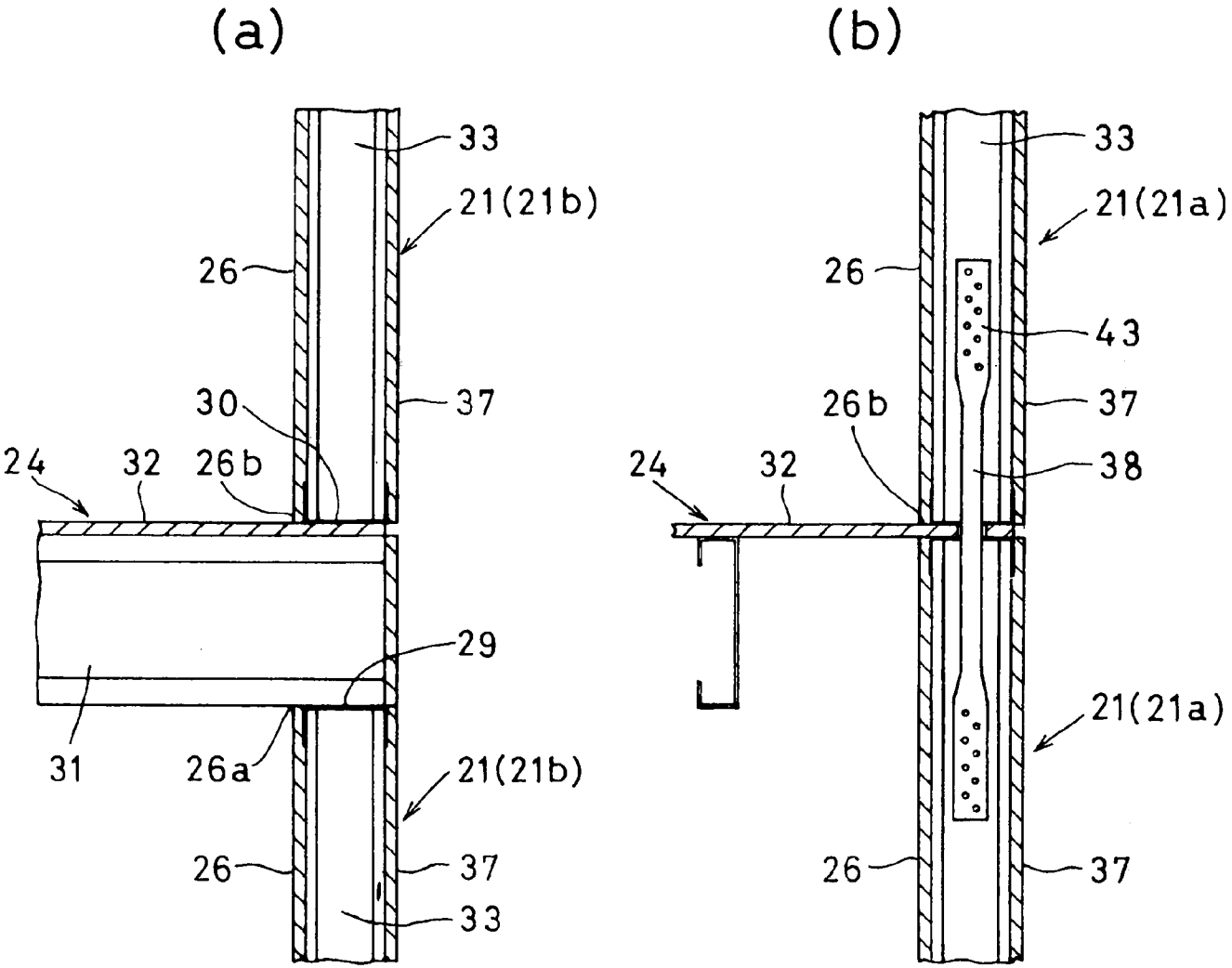
FIG. 2 is a detailed view showing a part of the structure shown in FIG. 1.
Figure 3:
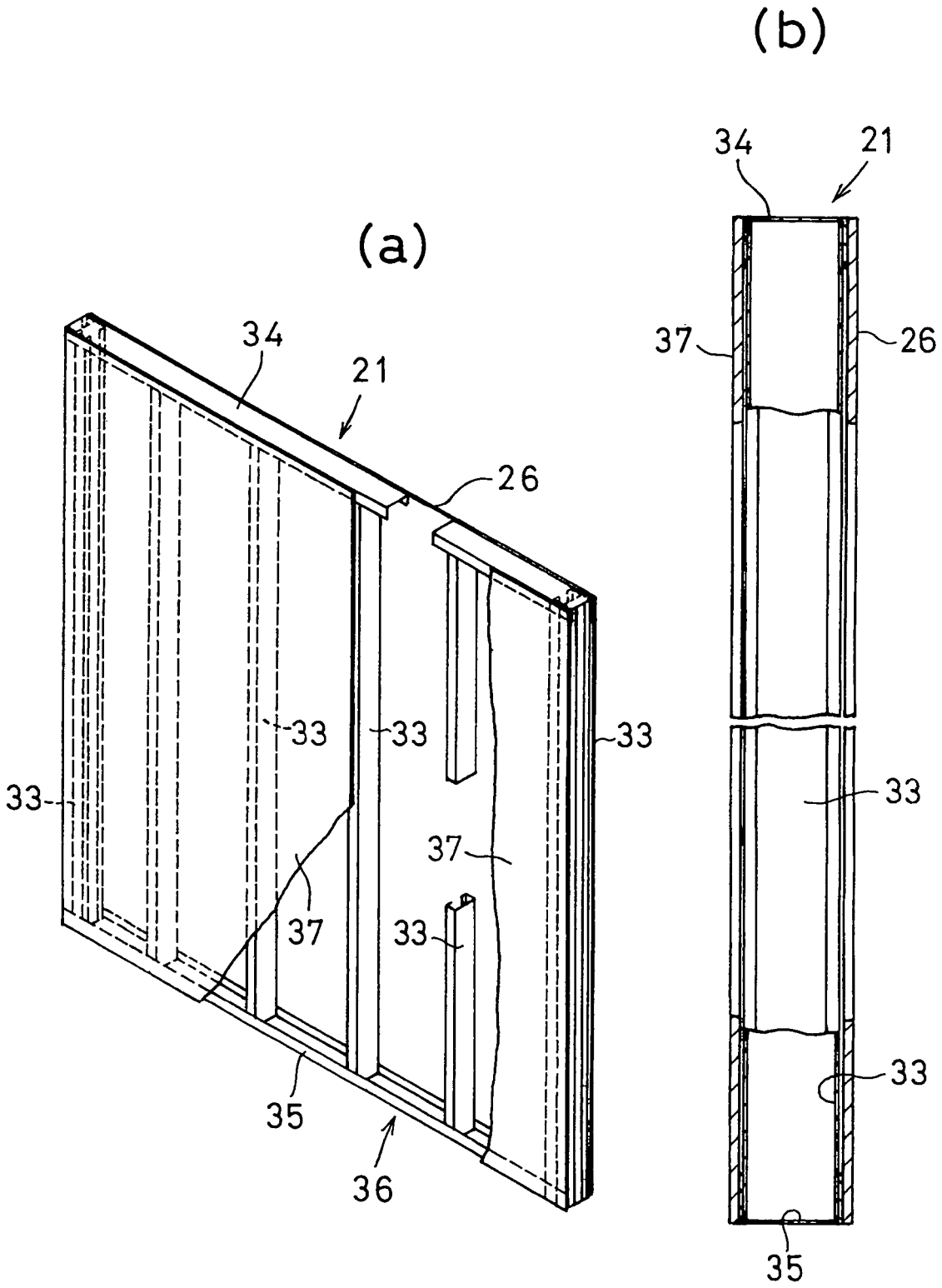
FIG. 3 shows a wall panel.

FIG. 1 shows the structure of a steel house, according to the present invention, schematically. FIGS. 2(*a*) and 2(*b*) are detailed views of parts A and B in FIG. 1. FIGS. 3(*a*) and 3(*b*) are a perspective and a vertical cross-sectional view of a wall panel.

Figure 4:
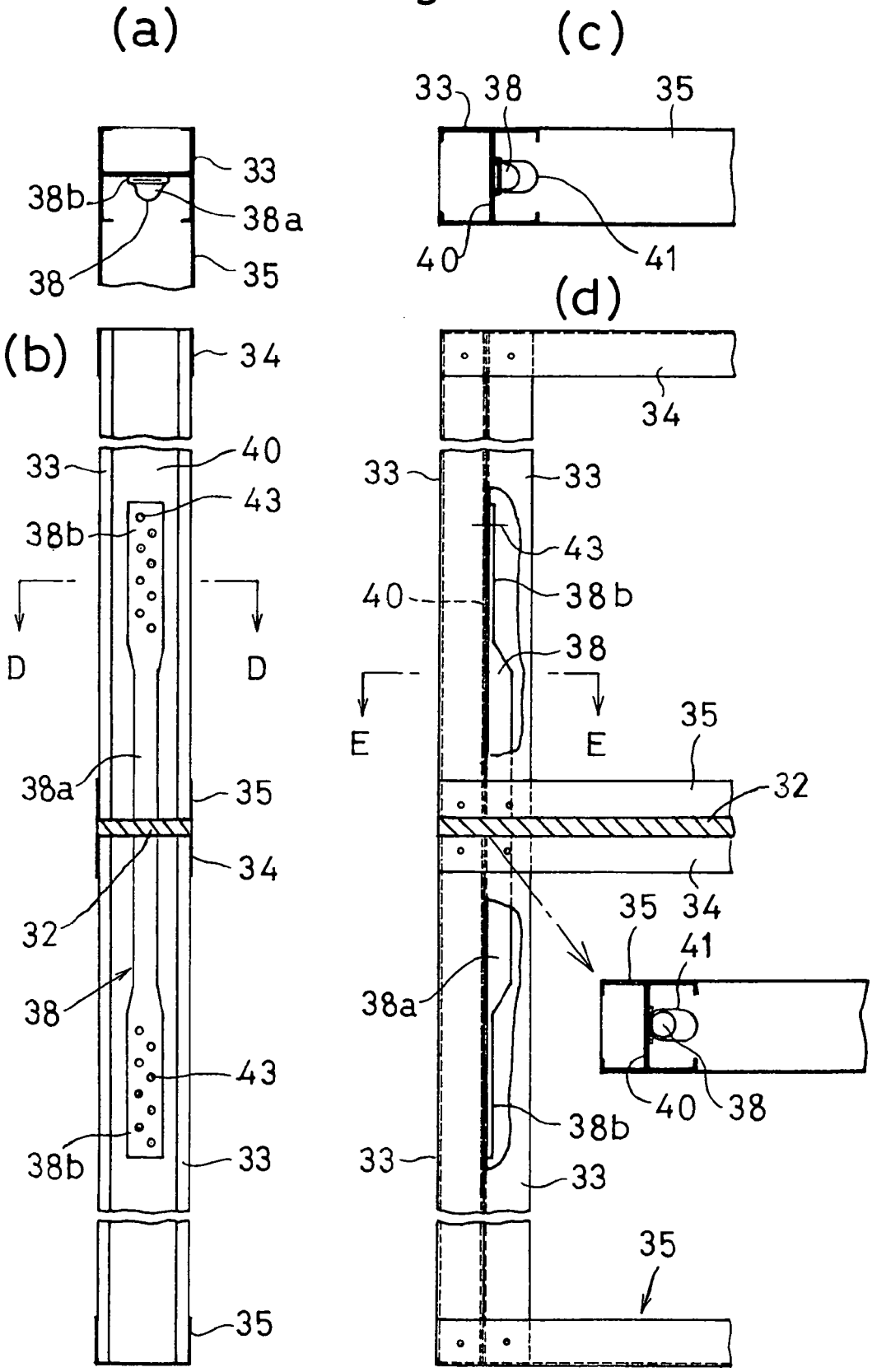
FIG. 4 is a detailed view of a connection structure of the wall panels of upper and lower stories.

FIG. 4 is a detailed view of a connection structure of wall panels of upper and lower stories. FIG. 4(*a*) is a cross-sectional view at D-D in FIG. 4(*b*). FIG. 4(*b*) is a side view of a connection structure of the wall panels of upper and lower stories. FIG. 4(*c*) is a cross-sectional view at E-E in FIG. 4(*d*). FIG. 4(*d*) is a front view of the connection structure of the wall panels of upper and lower stories.

Figure 5:
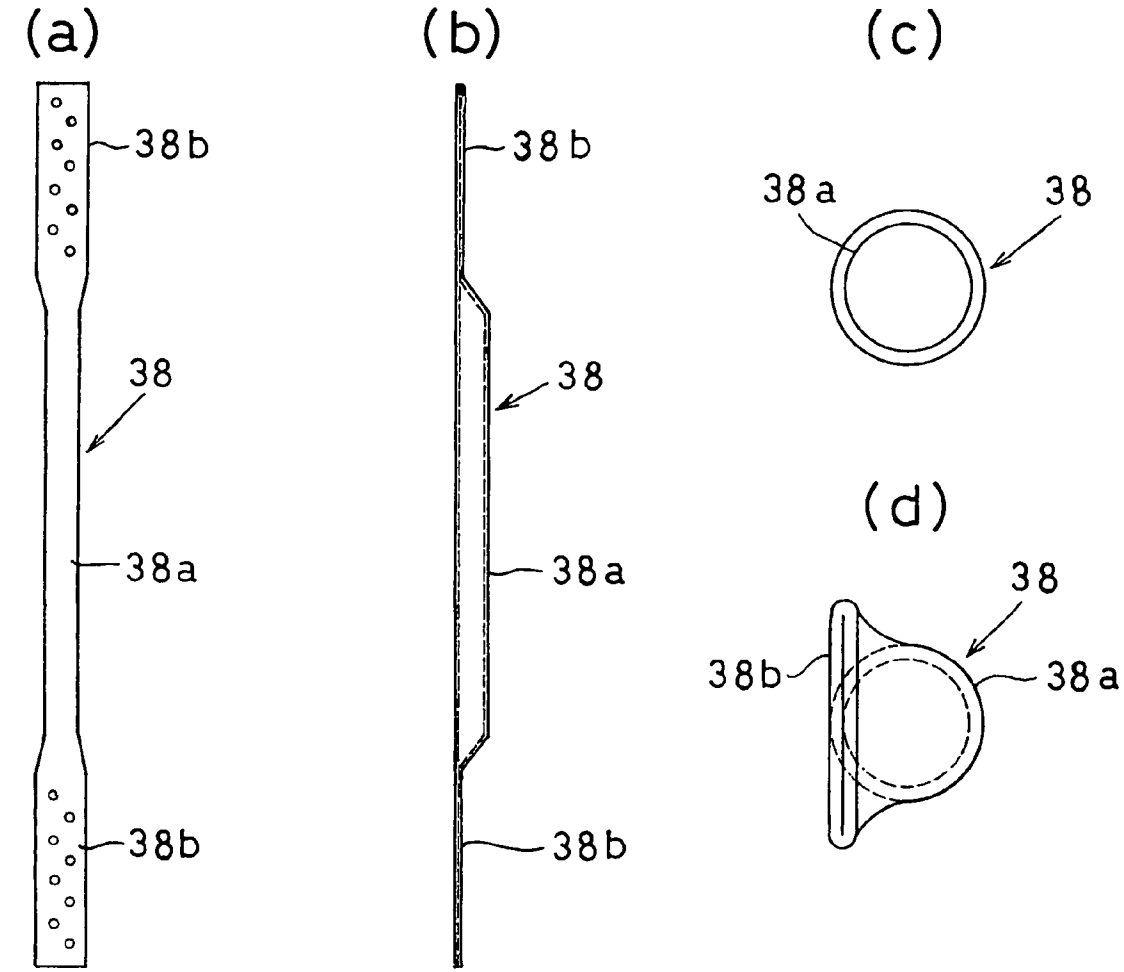
FIG. 5 shows connection hardware.
Figure 6:
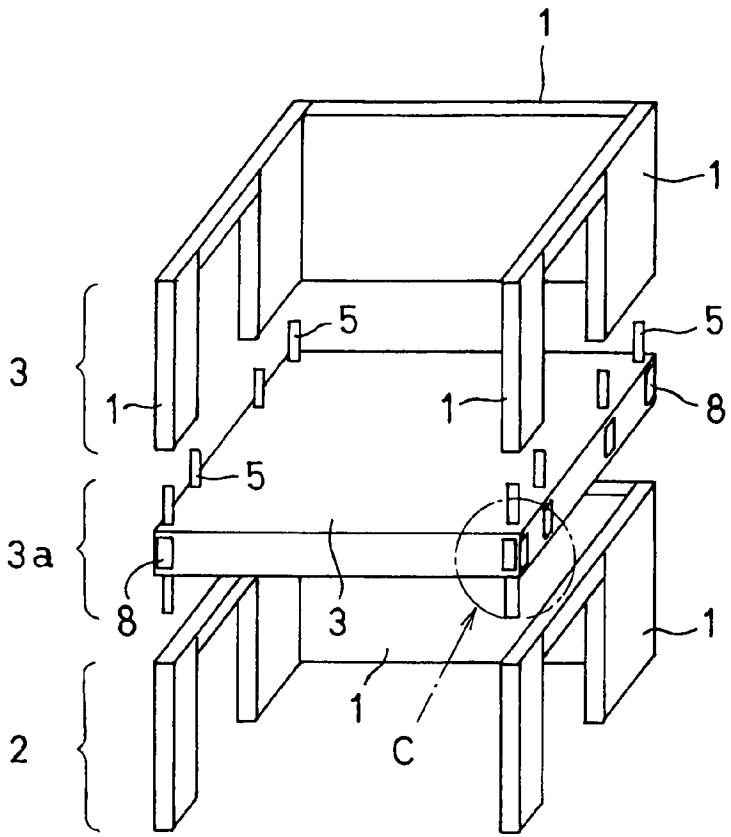
FIG. 6 shows a conventional platform structure design method schematically.
Figure 6:
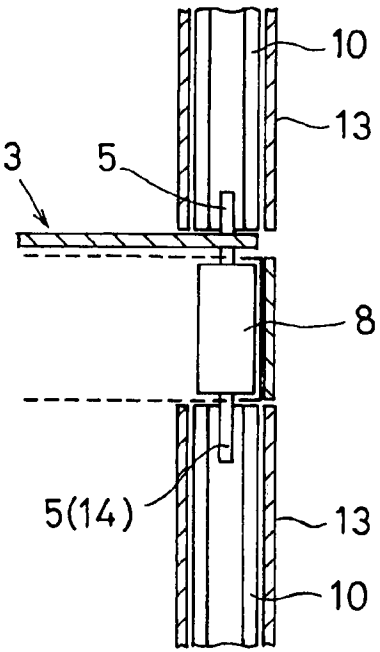
Figure 7:
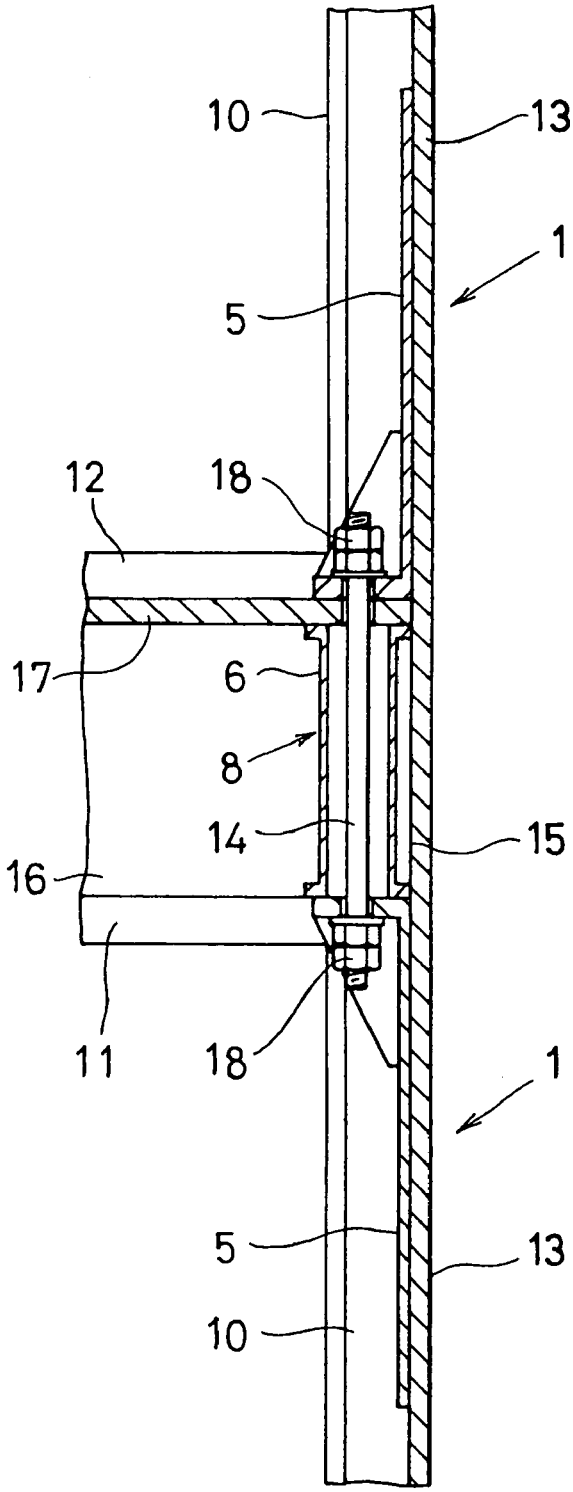
FIG. 7 shows a connection structure of upper and lower stories according to the conventional platform construction method.
Figure 7:
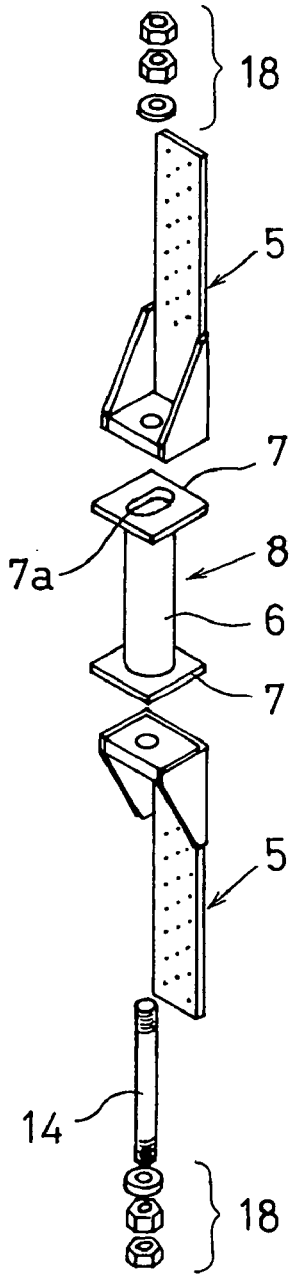

FIG. 5 shows connection hardware. FIG. 5(*a*) is a front view. FIG. 5(*b*) is a side view. FIGS. 5(*c*) and 5(*d*) show a process to compress the top and bottom ends of a tubular steel that is made into connection hardware.

An outline of the present invention is provided by referring to the schematic views of FIGS. 1 and 2. The panel constructing method of a steel house according to the present invention is partly analogous to the conventional platform constructing method. After completing the floor of the ground story (not shown) first, the walls 21*a* of the ground story are completed by mounting wall panels 21 thereon along the four sides of a rectangle.

Of the wall panels 21 for the ground story disposed along the four sides of a rectangle, the upper edges of the wall panels 21*b* on two opposite sides are provided lower than the upper edges of the wall panels 21*a* on the other two opposite sides. A floor 25 is provided by mounting both ends of a floor panel 24 on the upper edges of the lower wall panels 21*b* disposed along two opposite sides, as shown in FIGS. 1 and 2(*a*).

The floor panel 24 comprises a floor plate 32 mounted on floor joists (side joists and end joists) 31 of light-gage shapes of sheet steels. Both sides of the floor panel 24 are connected to the upper ends of the inner sides (face members) 26 of the wall panels 21*a* on the other two sides of the ground story, as shown in FIG. 2(*b*).

In FIG. 1, the ground story wall 22 and the second story wall 23 have openings 27 for doorways and wall panels 28 and lintel wall panels 28 disposed thereabove. The support structure of the floor panel 24 is, along with the connection structure of the wall panels 21 of the upper and lower stories described next, one of the main components of the present invention.

After the ground story wall 22 has been constructed by disposing the wall panels 21 (21*a*, 21*b*) and supporting the floor panel 24 of the upper story thereby, the second story 23 is constructed by the same procedure as in the case of the ground story. Here, the upper edges 29 of the two opposite wall panels 21*a* of the ground story wall 22 and the lower edges 30 of the two opposite wall panels 21*a* of the second story wall 23 are butt-connected. This connection is another main component of the present invention.

In the second story wall 24, as in the ground story wall 22, the upper edges of the two opposite wall panels 21*b* are held lower than the upper edges of the other two opposite wall panels 21*b*. Both ends of the ceiling panel (not shown) of the upper story are mounted on the upper edges of the lower two wall panels 21*b* and, as in the case of the ground story wall 22, connected to the upper ends 26*a* of the inner sides (face members) 26 of the two opposite wall panels 21*a* of the second story.

The lower ends of the wall panels 21 (21*a*, 21*b*) of the ground and second stories are disposed to be on the same level with each other. When the upper and lower edges 29 and 30 of the two opposite wall panels 21*a* of the upper and lower stories are butt-joined, the lower edges 30 of the two opposite wall panels 21*b* of the upper story hold the both edges of the floor panel 24, as shown in FIG. 2(*a*).

The lower edges 26*b* of the inner sides 26 of the two opposite wall panels 21*a* of the upper story hold the upper surface of the both edges of the floor panel 24, as shown in FIG. 2(*b*). Thus, a framework structure is completed by easily and surely fastening the upper and lower edges on the four sides of the floor panel 24 to the wall panels 21 of the upper and lower stories.

The present invention has the same advantage as the conventional platform construction method that permits constructing a structural framework including wall panels one story after another and, therefore, eliminates the need for heavy machines and scaffolds because the upper and lower edges of the two opposite wall panels 21*a* of the upper and lower stories are butt-joined and the upper edges of the wall panels 21*b* of the lower story hold the floor panel 24.

Besides, the present invention directly butt-joins the upper and lower edges 29 and 30 of the two opposite wall panels 21*a* of the upper and lower stories. This eliminates the shortcoming with the conventional platform construction method that connects the wall panels of the upper and lower stories by way of a floor panel disposed therebetween by eliminating the need for hold-down and other reinforcing hardware and, as a result, simplifying the detail of structural frameworks.

While both edges of the floor panel 24 are mounted on the upper edges of the two opposite wall panels 21*b* of the lower story in the illustrated example, both edges of the floor panel 24 may also be mounted on other supporting means.

The concrete structure of the wall panel 21, concrete supporting mechanism of the wall panel 21*a* and floor panel 24 of the upper and lower stories, and concrete connection means for directly butt-joining the upper and lower edges of the wall panels 21*a* of the upper and lower stories are described by referring to FIGS. 3 to 5.

The wall panel 21 comprises a rectangular wall frame 36, which consists of vertical frame members 33, an upper and a lower horizontal frame member 34 and 35 of light-gage channels of sheet steels, and an inner and outer wall members 26 and 37 attached to both sides thereof by means of fasteners 38, as shown in FIG. 3. Each story is constructed by erecting the unitized wall panels 21 along the four sides of a rectangle, as shown in FIG. 1.

The ends of the floor joists at both ends of the floor panel 24 are mounted on the upper member 34 attached to the upper end of the vertical frame members 33 of the two opposite wall panels 21*b* of the lower (ground) story and the inner and outer face members 26 and 37, as shown in FIG. 2(*a*). The lower frame member 35 attached to the lower end of the vertical frame members 33 of the wall panel 21 and the lower end of the inner wall 26 of the upper (second) story hold the upper side of the floor panel 32.

The inner side of the two opposite wall panels 21*a* of the lower (ground) story supports the ends of the floor joists 31 of the floor panel 23, as shown in FIG. 2(*b*). The lower edges of the inner wall members 26 of the wall panel 21*a* of the upper (second) story hold the upper side of the floor panel 32.

Butt-joining the upper and lower edges 29 and 30 of the wall panels 21*a* of the upper and lower stories permits direct support of the wall panels of the upper story by the upper ends of the wall panels 21 of the lower story. The use of the connection hardware of any given design shown in FIG. 2(*b*) insures this butt-joining of the upper and lower stories. The connection hardware 38 can be of simple structure. A concrete example of the connection hardware 38 is described by referring to FIGS. 4 and 5.

The connection hardware 38 shown in FIGS. 4 and 5 consist of a tubular steel of a given length having a tubular part 38*a* and compressed parts 38*b* prepared by compressing both ends thereof.

The connection hardware 38 is passed through an opening 41 provided in the web 40 of the upper and lower frame members 34 and 35 of light-gage channels of sheet steels that make up the wall panels 21 of the upper and lower stories. The upper and lower ends of the wall panels 21 of the upper and lower stories are surely butt-joined by fastening the upper and lower compressed parts 38*b* of the connection hardware 38 to said web 42 of the vertical frame members 33 of light-gage channels of sheet steels on both sides by mans of fasteners 43.

The connection hardware is by no means limited to the structure described above. For example, a strip cut from a steel plate of a given thickness can be fastened to the vertical frame members by means of fasteners.

The present invention (1) reduces field work load and simplifies design by simplifying details of the structural framework and eliminating the need for reinforcing hardware by directly connecting the wall panels 21 of upper and lower stories and (2) permits achieving the improvement described in (1) above while retaining the advantage of the conventional platform construction method by connecting the floor panel 24 to the inside of the wall panels 21.

INDUSTRIAL APPLICABILITY

As described above, the present invention has the following advantages: (1) Direction connection of the wall panels of upper and lower stories of a steel house permits simplifying framework construction, eliminating the need for hold-down and other complicated reinforcing hardware, reducing field work load, simplifying design and boosting construction efficiency; and (2) Connecting only the inner wall members by way of the floor panel as in the conventional method permits constructing one story after another by using unitized wall panels and, therefore, eliminated the need for heavy machines and scaffolds.

Thus the present invention has a great industrial applicability.

The invention claimed is:

1. A panel structure of steel house built by constructing multi-story structural frameworks by forming wall panels by fastening face members to rectangular frames of light-gage channels of sheet steels, constructing walls of each story by disposing said wall panels along the four sides of a rectangle, and assembling said wall panels and a floor panel comprising a wall plate mounted on floor joists, the panel structure characterized by that;

the upper edges of the wall panels of the lower story on two opposite sides are held lower than the upper edges of the wall panels of the lower story on other two opposite sides, and both edges of said floor panel are mounted on the upper edges of the lower wall panels of the lower story on two opposite sides, the upper surface of said floor panel is held by the lower edges of wall panels of the upper story on two opposite sides, and both sides of said floor panel are connected to the inner upper end of the higher wall panels of the lower story on the other two opposite sides, and the end edges of the higher wall panels of the lower story on two opposite sides and the end edges of the wall panels of the upper story on two opposite sides are butt-joined.

2. The panel structure of steel house according to claim 1, in which:

the end edges of the wall panels of the upper and lower stories on two opposite sides are butt-joined by using rigid hardware whose upper and lower parts are anchored by fasteners to the wall frames of the wall panels of the upper and lower stories.

3. The panel structure of steel house according to claim 2, in which:

said connection hardware is made of tubular steel of a given length compressed at both ends, said tubular steel being passed through an opening in the web of the upper and lower frames of light-gage channels of sheet steels, and the compressed parts of the upper and lower tubular steels being anchored by fasteners to the web of the wall frames.

4. A method for constructing a panel structure of steel house which includes steps of;

constructing the walls of a lower story by disposing wall panels along four sides of a rectangle, supporting both ends of the floor panel by the upper end of the wall panels of the lower story on two opposite sides that are lower than those on the other two opposite sides, connecting both sides of said floor panel to the upper inner end of the wall panels of the lower story, and holding the upper face at both ends of the floor panel by the lower end of the wall panels of the upper story on the other two opposite sides.

* * * * *

UNITED STATES PATENT AND TRADEMARK OFFICE

CERTIFICATE OF CORRECTION

PATENT NO. : 7,603,815 B2
APPLICATION NO. : 10/563552
DATED : October 20, 2009
INVENTOR(S) : Yoshimichi Kawai et al.

It is certified that error appears in the above-identified patent and that said Letters Patent is hereby corrected as shown below:

Title Page, insert the following:

-- (30) Foreign Application Priority Data

November 25, 2004 (JP) 2004-340130 --.

Signed and Sealed this

Eighteenth Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,603,815 B2
APPLICATION NO. : 10/563552
DATED : October 20, 2009
INVENTOR(S) : Kawai et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 693 days.

Signed and Sealed this

Fifth Day of October, 2010

David J. Kappos

David J. Kappos
*Director of the United States Patent and Trademark Office*